US005156469A

United States Patent [19]

Tanaka et al.

[11] Patent Number: 5,156,469

[45] Date of Patent: Oct. 20, 1992

[54] IMPACT DOT PRINTER

[75] Inventors: Minoru Tanaka; Takashi Asada, both of Suwa, Japan

[73] Assignee: Seiko Epson Corporation, Tokyo, Japan

[21] Appl. No.: 809,894

[22] Filed: Dec. 18, 1991

[30] Foreign Application Priority Data

| | | | |
|---|---|---|---|
| Dec. 18, 1990 | [JP] | Japan | 2-400901 |
| Feb. 15, 1991 | [JP] | Japan | 3-21741 |
| Feb. 15, 1991 | [JP] | Japan | 3-21747 |
| Nov. 7, 1991 | [JP] | Japan | 3-291670 |

[51] Int. Cl.[5] ..... B41J 3/02

[52] U.S. Cl. ..... 400/124; 101/93.05

[58] Field of Search ..... 400/124; 101/93.05

[56] References Cited

U.S. PATENT DOCUMENTS

| | | | |
|---|---|---|---|
| 4,407,591 | 10/1983 | Adamoli et al. | 400/124 |
| 4,575,268 | 3/1986 | Yang et al. | 400/124 |
| 4,594,010 | 6/1986 | Jachno | 400/124 |
| 4,661,002 | 4/1987 | Ara | 400/124 |
| 4,697,939 | 10/1987 | Ara | 400/124 |
| 4,767,227 | 8/1988 | Mitsuishi et al. | 400/124 |
| 4,792,247 | 12/1988 | Sakaida et al. | 400/124 |
| 4,810,112 | 3/1989 | Gaiardo | 400/124 |
| 4,884,905 | 12/1989 | Smith | 400/124 |
| 4,921,364 | 5/1990 | Yasunaga | 400/124 |
| 4,944,615 | 7/1990 | Kato et al. | 400/124 |
| 4,950,092 | 8/1990 | Kikuchi et al. | 400/124 |
| 4,993,854 | 2/1991 | Sato | 400/124 |
| 5,040,909 | 8/1991 | Mizuno | 400/124 |
| 5,056,941 | 10/1991 | Kato et al. | 400/124 |
| 5,056,942 | 10/1991 | Norigoe | 400/124 |
| 5,096,313 | 3/1992 | Horii | 400/124 |

*Primary Examiner*—Eugene H. Eickholt
*Attorney, Agent, or Firm*—Blum Kaplan

[57] ABSTRACT

An improved impact dot print head having improved electrical integrity and improved heat radiating qualities is provided. The print head includes a magnetic frame, a plurality of solenoids coil for driving print wires mounted on the frame, a nose for guiding the wires, a printed circuit board mounted on the nose and electrically connected to a terminal part of the solenoid coil holes in a spacer disposed between the frame and printed circuit board. The spacer, frame, printed circuit board and nose are positioned to prevent rotational and translational movement. The spacer is an insulating material or metal coated with an insulator for radiating heat away from the print head and allows a low viscosity silicone resin to be injected into the frame for assisting in transferring heat.

33 Claims, 14 Drawing Sheets

IMPACT DOT PRINTER

BACKGROUND OF THE INVENTION

The invention relates to an impact dot printer, and more particularly, to an impact dot printer including a print head having a plurality of driving solenoid coils for causing a plurality of print wires to impact a platen.

Generally, a printing wire of a wire impact dot head is driven utilizing the electromagnetic force of a solenoid coil. The solenoid coil is mounted in a magnetic frame and a terminal part thereof is soldered to a printed board through a hole provided on the bottom face of the frame. Since the frame is magnetic and is electrically conductive, a spacer made from a non-conductive material, such as plastic, is provided between the frame and the printed circuit board to prevent a short-circuit between the terminal part of the coil and the printed circuit board and frame. A heat radiating member is included to contact the peripheral edge of the frame. Heat generated by the solenoid coils is transferred from the magnetic core which contacts the solenoid coils to the peripheral edge of the frame and is then transferred to the radiating member which dissipates the heat into the air. In addition, in order to transfer the heat from the solenoid coil to the peripheral edge of the frame, a heat conducting resin such as silicone is injected between the frame and the coil. Alternatively, the coils can be directly soldered to the frame and the printed circuit board, negating the need for resin. The silicone is in liquid form when injected and solidifies after injection via natural or ultraviolet hardening in air.

The aforementioned structure is disadvantageous if low viscosity silicone is injected between the frame and coils because it can leak between the spacer and the printed circuit board before hardening. As a result, the silicone cannot be retained at the proper locations. Furthermore, any silicone which leaks must be removed during assembly. Accordingly, highly viscous silicone of more than 450 poise must be used for this application.

A print head 136 constructed and arranged in accordance with the prior art is illustrated in FIG. 1 and illustrates the difficulties encountered with this construction. Print head 136 includes a nose 101 coupled to a frame 102 with a plurality of solenoid coils 116 wound about coil bobbins 117 and positioned within frame 102. A printed circuit board 109 is disposed between frame 102 and nose 101 for electrically connecting coils 116 to a source of print signals. A spacer 108 is disposed between frame 102 and printed circuit board 109.

A plurality of levers 118 are mounted in frame 102 with a print wire 107 at the free end of each lever 118. Wires 107 extend through nose 101. Printed circuit board 109 is soldered to a coil terminal pin 112 to provide the electrical connection between printed circuit board 109 in order to control print head 136. When solenoid coils 116 are selectively energized, levers 118 are attracted to core 111 to drive wire 107 out of nose 101 to impact on a print medium. Spacer 108 is a thin plastic member disposed between printed circuit board 109 and frame 102 to avoid short-circuiting between solenoid coil 116 and frame 2 which would degrade performance. However, problems arise if spacer 108 is thin because solder is able to flow from printed circuit board 109 to frame 102 during assembly causing a short-circuit.

When spacer 108 is thickened in order to prevent solder flow and short-circuit, another problem arises. A projection 124 formed on nose 101 which joins frame 102 to nose 101 through an aperture must be lengthened in order to provide a proper fit. This is a difficult process because nose 101 is generally manufactured by injection molding or die casting. Thus, if projection 124 is significantly lengthened, it becomes weak and tends to break during assembly.

If a resin, such as silicone is not utilized, there is a limit to the amount of heat which can be effectively radiated for suppressing the temperature increase in the conventional printing head due to the heat generated over time when heat is transferred from the solenoid coil to the core and is rad ated at the peripheral edge of the frame through the radiating member. Accordingly, it has been difficult to increase printing speed because the solenoid coils can burn out due to the temperature rise in the head. This in turn degrades the printing quality and life of the print head.

Referring to FIGS. 1, 2 and 3, if high viscosity silicone 120 is injected into print head 136, the heat generated by solenoid coil 116 cannot be fully released during high print duty. Because silicone 120 is viscous, it cannot reach a bottom face 110 of frame 102, the lower part of solenoid coil 116 or a protrusion part 121 of coil bobbin 117 as shown in FIG. 3. In addition, as shown in FIG. 3, resin 120 barely flows between adjoining solenoid coils 116.

Another problem arises in that the lower part of solenoid coil 116 and coil terminal pin 112 are fixed to printed circuit board 109 by solder. These components are influenced by vibration generated when print wire 107 is driven during printing. Where there is a winding sag or slack exists on coil 116, the vibration of print head 136 during printing causes friction between the slack wire portion and frame 102 causing the wire insulation to wear off. This in turn results in a short-circuit between solenoid coil 116 and frame 102.

Accordingly, it is desired to provide an impact dot printer having a wire impact dot print head which overcomes these problems encountered in the prior art and which provides a highly reliable print head which avoids short-circuit between the solenoid coil and the frame. The printer should be one in which heat dissipation and electrical integrity is increased while maintaining a structure which is durable and easily allows accurate positioning of the nose and frame during assembly.

SUMMARY OF THE INVENTION

Generally speaking, in accordance with the invention, a wire impact dot printer includes a print head having a frame of a magnetic material, solenoid coils for driving print wires, a printed circuit board electrically connected to terminal parts of the solenoid coils through holes in the bottom face of the frame, a spacer member between the frame and the printed circuit board and a nose for guiding the print wires to a predetermined position. The spacer member is positioned in the center of the frame by a projection extending external of the frame. The spacer member and the nose are rotationally positioned by anchoring a hole or concave part provided on the frame and a convex part provided on the nose.

The spacer member, constructed and arranged in accordance with the invention, is formed of a ceramic material having excellent thermal conductivity and electrical insulating quality or a metal upon which an insulating coating is applied. The spacer should also have a thickness greater than about 0.5 mm. The spacer member is formed with a plurality of large through holes so that the spacer member does not contact the terminal pin of the solenoid coil, thereby allowing the spacer member to be formed of a metal (e.g., aluminum) having good thermal conductivity regardless of its electrical insulating properties. In a preferred embodiment, the spacer member extends outwardly to form a heat-radiating fin structure and may abut a carriage on which the head is mounted; and low viscosity silicone (e.g., 50–400 poise) is injected in openings between the solenoid coil, the frame and the spacer member.

Accordingly, it is an object of the invention to provide an improved impact dot print head.

Another object of the invention is to provide an impact dot print head which effectively dissipates heat.

A further object of the invention is to provide a impact dot printer which possesses high electrical integrity while maintaining an easily manufactured and durable structure.

A still further object of the invention is to provide an impact dot print head which allows accurate positioning of the nose and frame during assembly.

Still other objects and advantages of the invention will in part be obvious and will in part be apparent from the specification.

The invention accordingly comprises the features of construction, combination of elements and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description, taken in connection with the accompanying drawings, in which.

DESCRIPTION OF THE PREFERRED EMBODIMENTS

Figure 4:
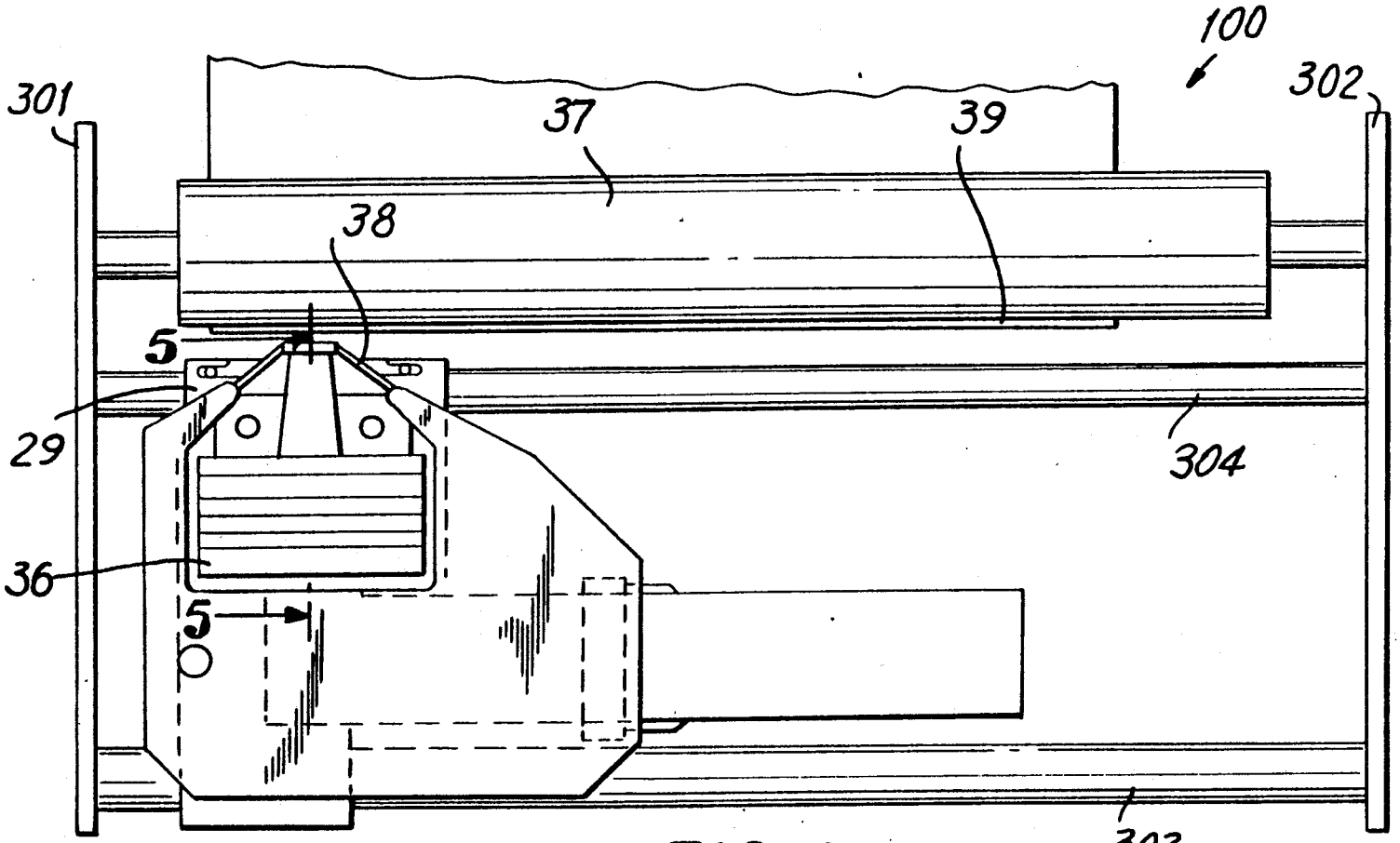
FIG. 4 is a top plan view of a wire impact dot printer constructed in accordance with the invention.

FIG. 4 illustrates the mechanical elements of an impact dot printer 100 constructed and arranged in accordance with the invention. Printer 100 includes a wire dot print head 36 constructed in accordance with the various embodiments of the invention.

Printer 100 includes a left side frame 301 and a right side frame 302 which support a rear guide rail 303 and a front guide rail 304. A platen 37 is rotatably supported on left frame 301 and right frame 302 adjacent to front rail 304. Print head 36 is mounted on a carriage 29 which is slidably mounted on front rail 304 and rear rail 303 for travel in the direction along platen 37. A print medium, such as a paper 39, is fed between platen 37 and an ink ribbon 38 mounted on carriage 29 for printing any desired pattern of characters and the like.

Figure 5:
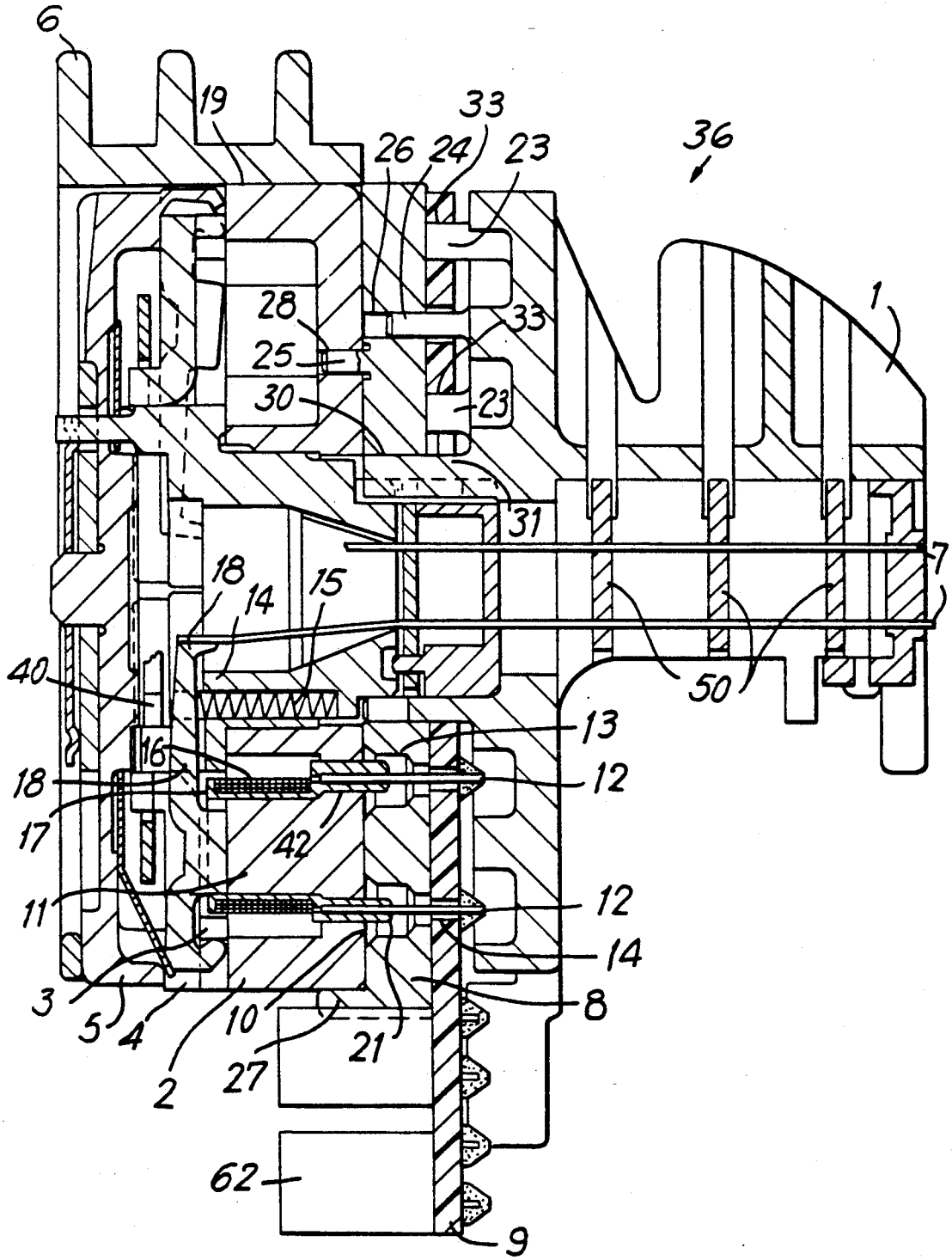
FIG. 5 is a cross-sectional view of an impact dot print head constructed in accordance with a preferred embodiment of the invention taken along line 5—5 of FIG. 4.
Figure 6:
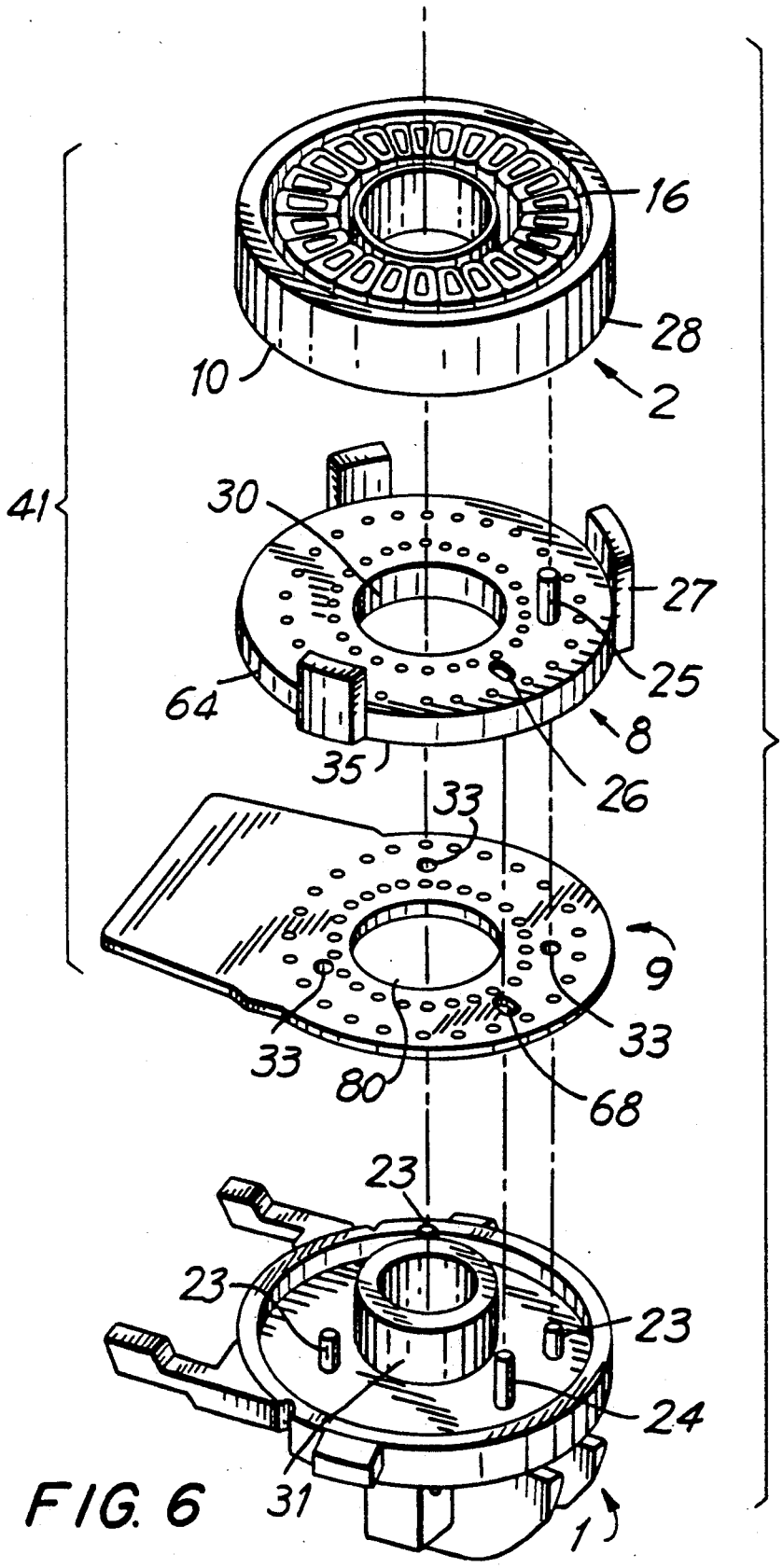
FIG. 6 is an exploded perspective view showing the elements of the impact dot printer of FIG. 5.

FIGS. 5 and 6 illustrate a more detailed representation of print head 36 constructed and arranged in accordance with a first preferred embodiment of the invention. Print head 36 includes a frame 2 and a printed circuit board 9 supported thereon which connects print head 36 to an external device for generating print signals in the usual manner (not shown) by a connector 62. Frame 2 is formed of a magnetic material and has a cylindrical shape and a plate-like bottom face 10 formed on one side thereof. A heat radiating member 6 is secured to a peripheral edge 19 of frame 2 to aid in transferring heat away from print head 36.

A plurality of cores 11 are disposed circumferentially about frame 2 on the inner face of bottom 10. A plurality of solenoid coils 16 are mounted on cores 11. A coil bobbin 17 is integrally formed with coil bobbin projections 21 for holding a coil wire. A coil terminal pin 12 is mounted on the head of projection 21. Both ends of the coil wire of each coil 16 are wound around coil bobbin 17 and connected to coil terminal pin 12 through bobbin projection 21. Projection 21 is inserted into respective through holes 42 in bottom face 10 of frame 2.

A spacer 8 is interposed between printed circuit board 9 and bottom face 10 of frame 2. Spacer 8 is made from an insulating plastic material. Both spacer 8 and printed circuit board 9 are formed with holes corresponding to the position of coil terminal pins 12 of solenoid coils 16. Coil terminal pins 12 extend through corresponding openings in spacer 8 and printed circuit board 9. Once coil terminal pins 12 are extended through holes 13 in spacer 8 and holes 74 in printed circuit board 9, they are soldered to printed circuit board 9. Spacer 8 protects print head 36 during manufacturing, specifically when printed circuit board 9 is soldered to coil terminal pin 12. Spacer 8 also acts to prevent a short-circuit caused if solder flows onto the back of printed circuit board 9 and contacts bottom face 10.

A lever 18 of a magnetic material is rotatably supported on frame 2 facing core 11. A first yoke 3 and a second yoke 4 are mounted on frame 2 and lever 18. A print wire 7 is fixed at one end to lever 18 at a free end 18'. Each wire 7 is urged towards a reset or at rest position against the back wall of damper member 40 by a reset spring 15 mounted in a spring holder 14 which is disposed along the inner circumference of core 11 on frame 2. Wire 7 is also supported by first yoke 3 and second yoke 4. A damper member 40 is mounted at the middle of a lever holder 5 abutting the upper face of spring holder 14 to bias lever 18 in the opposite direction of reset spring 15. A plurality of guiding members 50 for guiding print wires 37 are incorporated in nose 1.

In the construction described above, when current is provided to solenoid coils 16 based on printing signals fed from the external print signal source to printed circuit board 9 through connector 62, a magnetic circuit including frame 2, first yoke 3, second yoke 4 and lever 18 is formed. This magnetic circuit causes lever 18 to be attracted by core 11 and move towards bottom face 10 against the force of reset spring 15 thereby forcing print wire 7 to extend beyond nose 1 and impact a print medium.

In order to utilize spacer 8 properly, spacer 8 must be securely fastened to printed circuit board 9, frame 2 and nose 1 to prevent movement of the spacer 8, frame 2 and printed circuit board 9 during printing. Referring specifically to FIG. 6, spacer 8 is shown as an annular planar disk with three positioning projections 27 extending perpendicularly from an edge 64 thereof and a rotation positioning member 25 integrally formed thereon. Spacer 8 is positioned in frame 2 by engaging positioning projections 27 around the outer wall of frame 2 and inserting rotational positioning member 25 on spacer 8 into a hole 28 formed in bottom face 10.

Spacer 8, printed circuit board 9 and nose 1 are aligned properly by inserting positioning member 31 on nose 1 through a central opening in printed circuit board 9 and central opening 30 in spacer 8. The parts are aligned rotationally by inserting a first nose positioning projection 24 on nose 1 through a positioning hole 68 in printed circuit board 9 and positioning hole 26 in spacer 8. Nose 1 also includes second nose positioning projections 23 which fit into holes 33 in printed circuit board 9 and abut a bottom face 35 of spacer 8 to position spacer 8 and nose 1 in the laminating direction.

A frame assembly 41 includes frame 2 and solenoid coils 16, spacer 8 and printed circuit board 9. Frame assembly 41 is mounted to nose 1. The three positioning projections 23 on nose 1 fit through holes 33 in printed circuit board 9 with single projection 24 on nose 1 extending through hole 26 in spacer 8 so that frame assembly 41 is properly aligned and disassembly is prevented.

Figure 7:
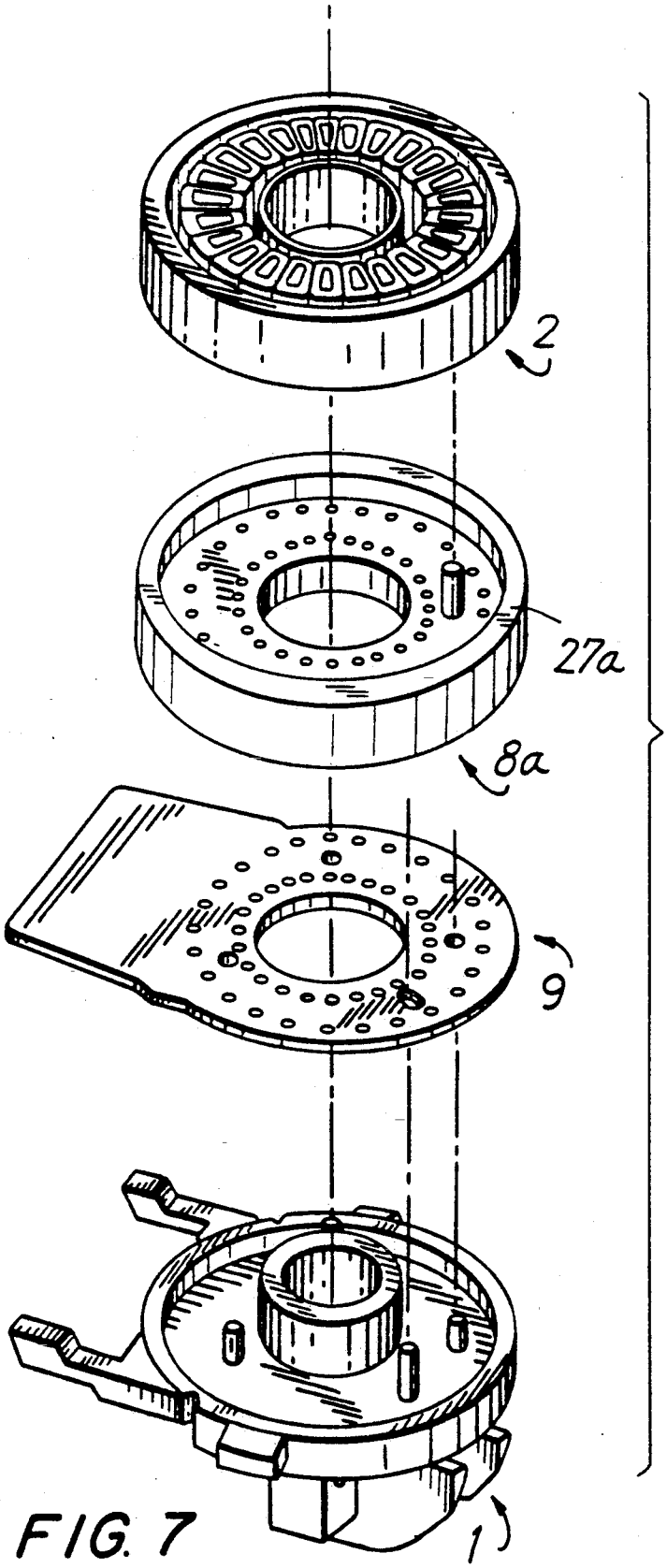
FIG. 7 is an exploded perspective view showing the elements of the impact dot print head of FIG. 5 when the shape of the projecting portion of FIG. 6 is altered in accordance with a second embodiment of the invention.

First nose positioning projection 24 and second nose positioning projections 23 are not limited as to their shape (e.g. cylindrical or ellipse). Moreover, the shape of hole 26 in spacer 8 need not have the same cross-sectional shape of the first nose positioning projection 24, so long as its shape allows for engagement of spacer 8 with nose 1 to prevent rotation. Furthermore, hole 26 of spacer 8 need not be a through hole. It may be a notch sufficient to allow first nose positioning projection 24 to fit therein. Similarly, the shape of projection portions 27 of spacer 8 may be such that a cylindrical positioning portion 27*a* of spacer 8 engages the entire outer peripheral portion of frame 2 as shown in FIG. 7.

In this second embodiment in accordance with the invention, spacer 8 is made from an insulating ceramic material or a metal such as aluminum on which an insulating coating is applied. This structure allows heat generated by solenoid coil 16 to be transferred from core 11 to bottom face 10 of frame 2 and from bottom 10 to spacer 8. In this embodiment, the ratio of the area of frame 2 that abuts spacer 8 and the area of peripheral edge of frame 2 that abuts a radiation member 6 is almost 2:1 to 1:1. That is, the area of frame 2 abutting spacer 8 is usually larger. The temperature of bottom face 10 is higher than that of peripheral edge 19, since bottom 10 is closer to the heating unit compared to peripheral edge 19. Accordingly, the amount of heat transferred to spacer 8 is greater than the amount transferred to radiation member 6. However, the heat cannot be effectively released if the thickness of the spacer 8 is between about 0.1 mm to about 0.4 mm.

Since the thickness of spacer 8 is increased to more than 0.5 mm in accordance with this embodiment, spacer 8 has the same heat radiating characteristics as heat radiation member 6 which contacts peripheral edge 19. Since spacer 8 has excellent radiation characteristics, the heat radiation performance is almost twice that of the printing heads constructed in accordance with the prior art.

Figure 8:
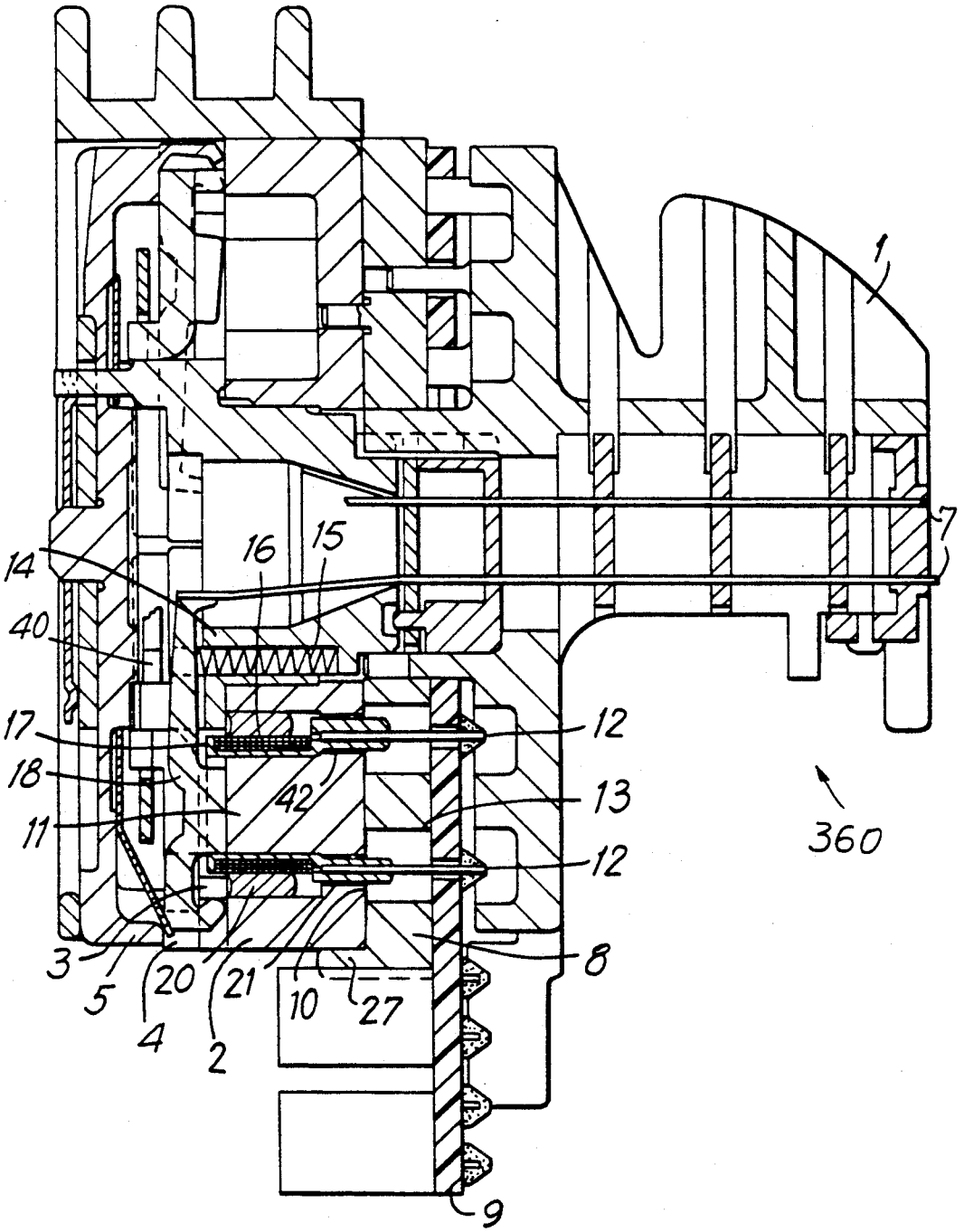
FIG. 8 is a cross-sectional view of an impact dot print head constructed in accordance with a further embodiment of the invention.

Print head 360 constructed in accordance with a third embodiment of the invention is illustrated in FIG. 8. In this embodiment, hole 13 in spacer 8 for receiving coil protrusion member 21 is enlarged so that solenoid coil 16 and coil protrusion portion 21 do not contact spacer 8. Accordingly, spacer 8 need not have as great insulating properties as in the second embodiment of FIG. 7. Spacer 8 can be formed of a metal such as aluminum or ceramic in order to provide efficient heat transfer. This not only permits one to widen the degree of freedom in designing spacer 8 compared to the first and second embodiments, but also to lower significantly the cost since the insulating process becomes unnecessary when a metal is used as spacer 8.

Figure 9:
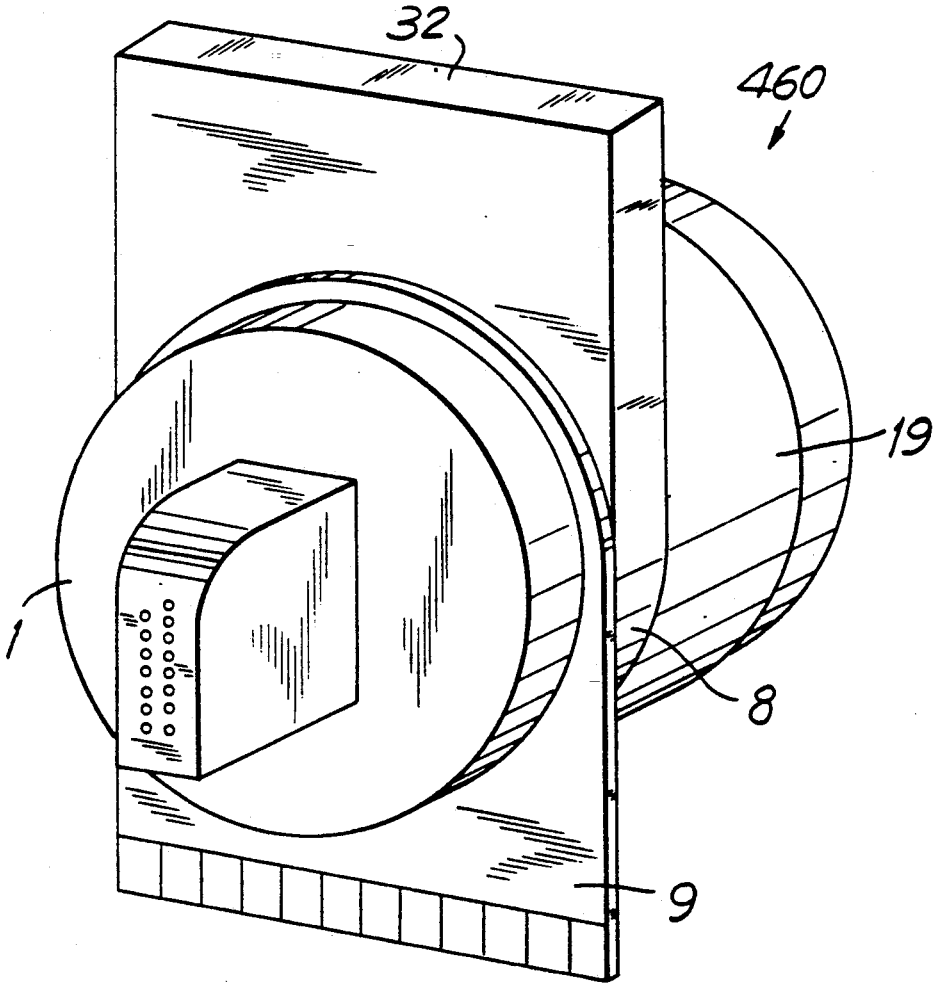
FIG. 9 is a perspective view of an impact dot print head constructed in accordance with another embodiment of the invention.
Figure 10:
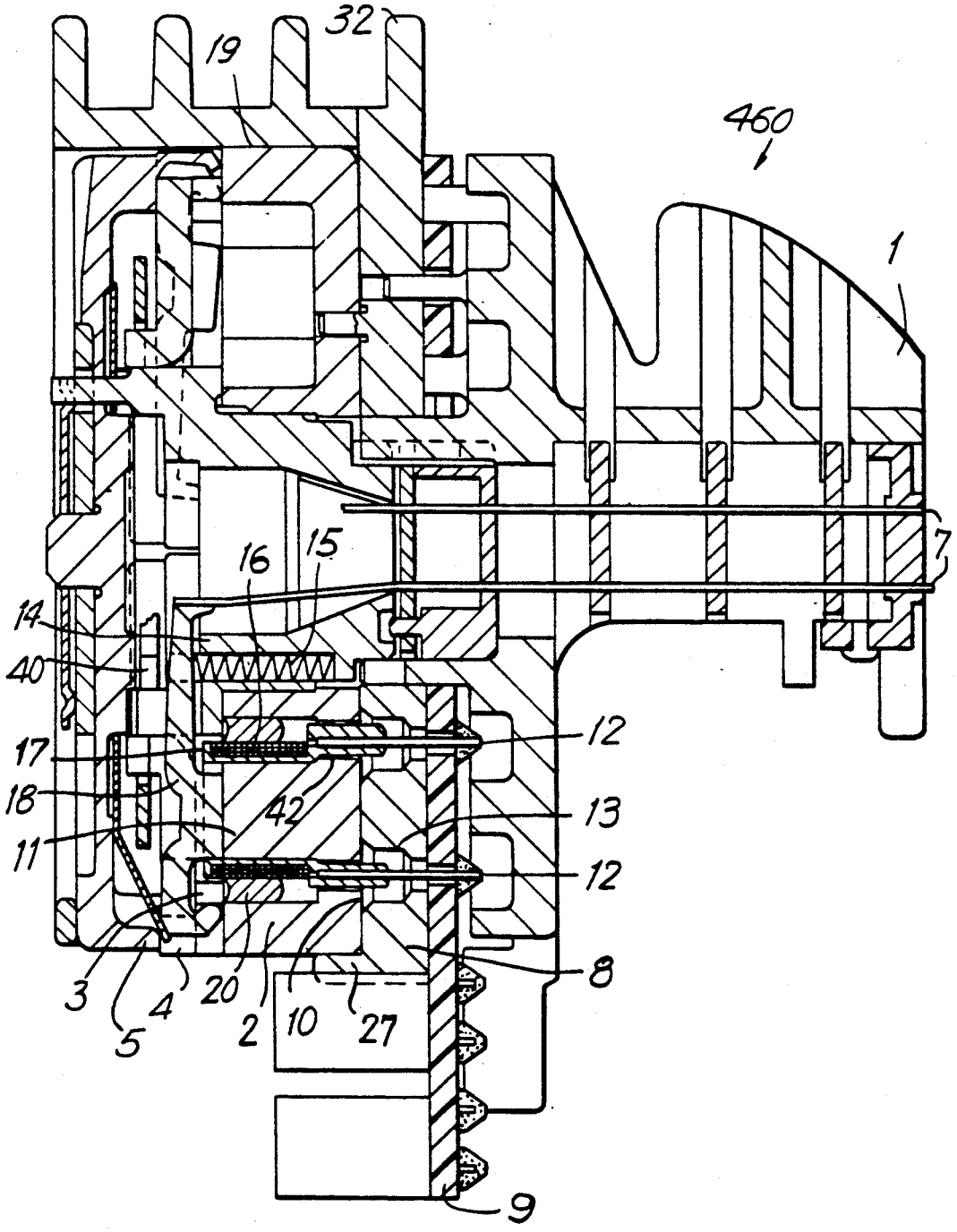
FIG. 10 is a cross-sectional view of an impact dot print head constructed in accordance with yet another embodiment of the invention.

A print head 460 constructed in accordance with the fourth embodiment of the invention is shown in FIG. 9. In this embodiment, in order to release heat transferred to spacer 8 more effectively, spacer 8 is formed with a heat releasing fin 32 which extends beyond frame 2. Print head 460 illustrates a construction in which peripheral edge portion 19 of spacer 8 extends to the peripheral end of frame 2. This embodiment is illustrated in cross-section in FIG. 10. By enlarging heat releasing fin 32, print head 36 has even better heat radiating qualities.

Figure 11:
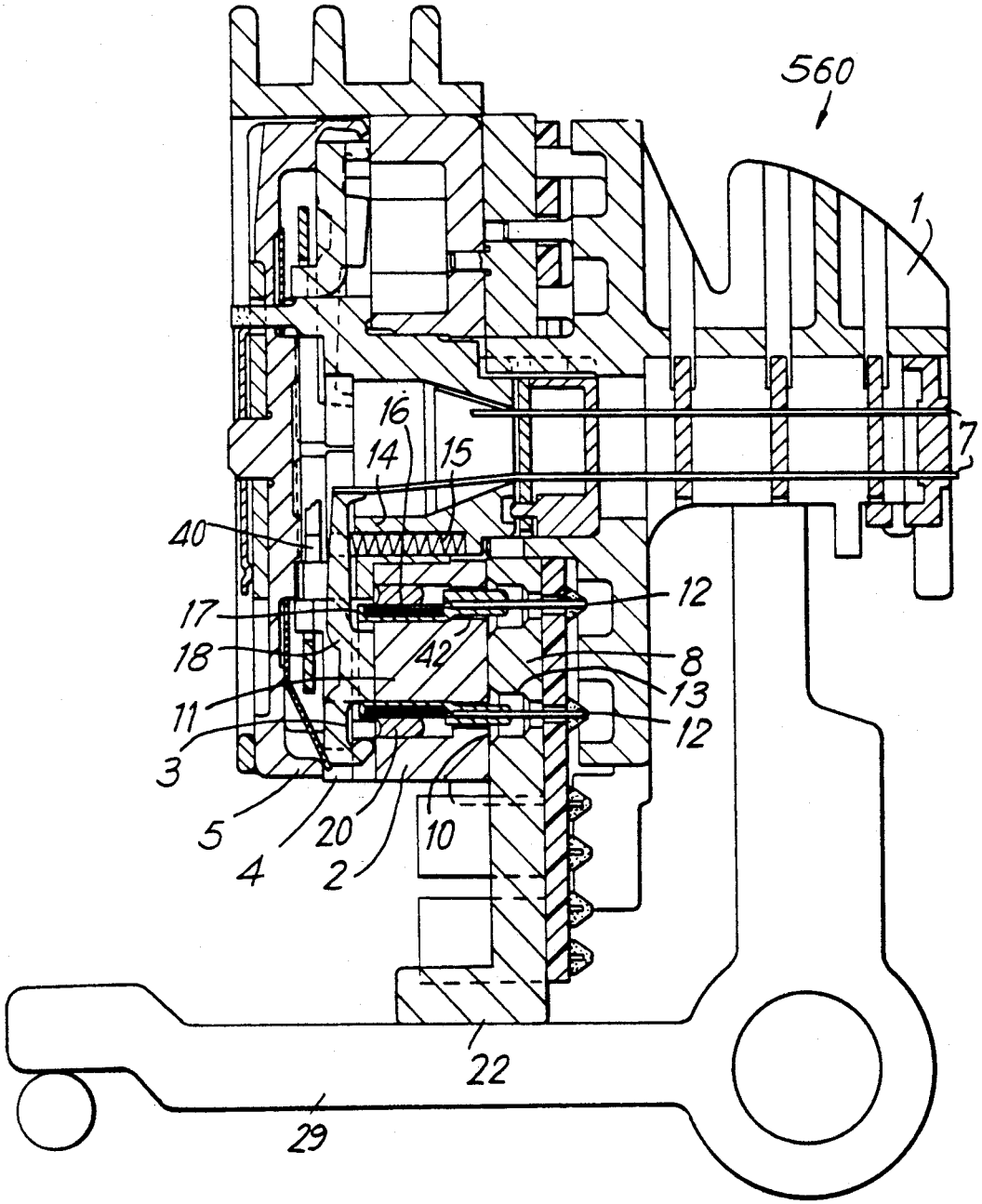
FIG. 11 is a cross-sectional view of an impact dot print head constructed in accordance with yet a further embodiment of the present invention.

FIG. 11 shows a print head 560 constructed in accordance with a sixth embodiment of the invention. In order to release heat transferred to spacer 8 more effectively, spacer 8 is extended and an extruded portion 22 contacts a carriage 29 on which print head 36 is mounted. As a result, heat is transferred from solenoid coil 16 to frame 2 to spacer 8 to extruded portion 22 and finally to carriage 29, thereby providing superior heat radiating capability.

Figure 12:
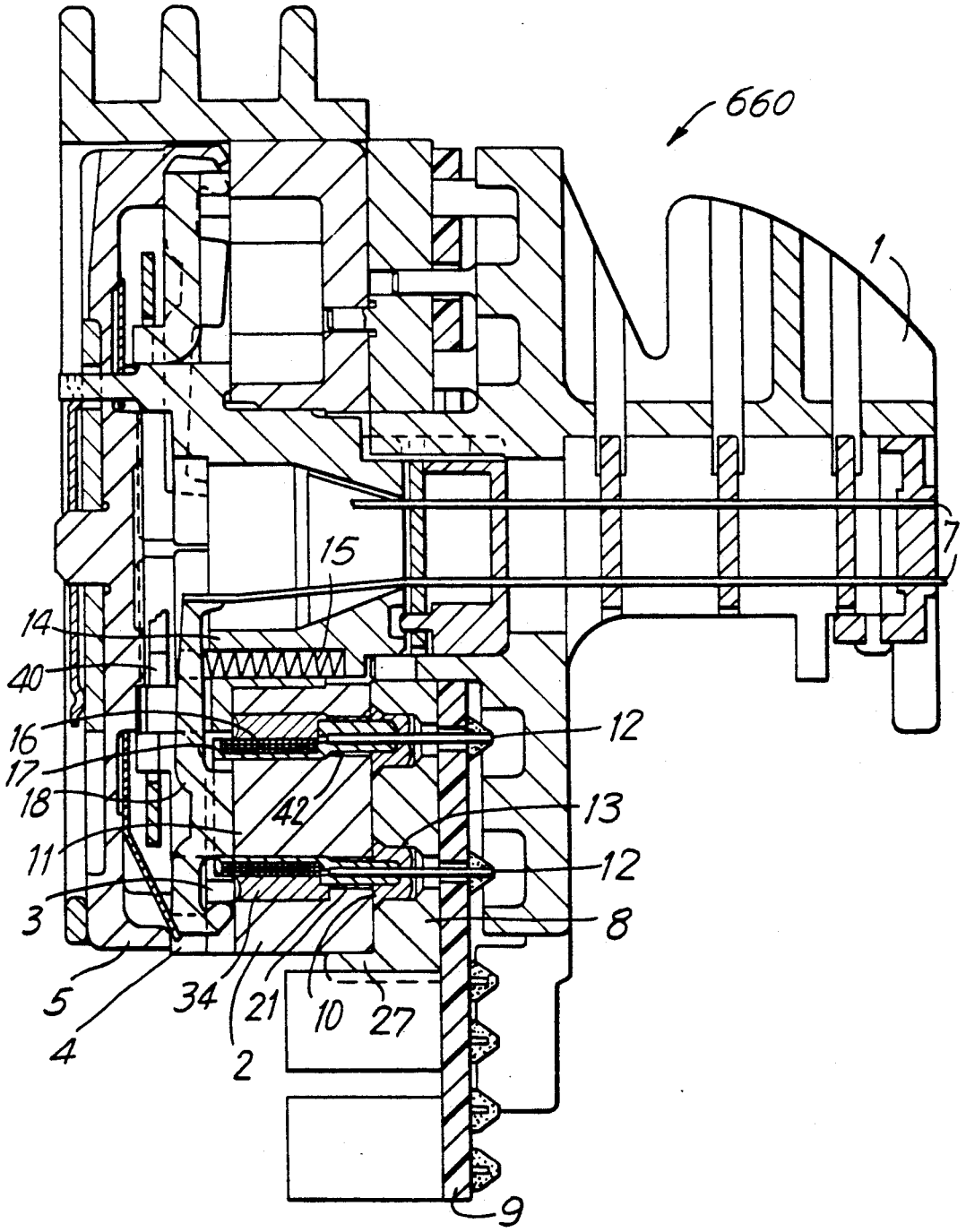
FIG. 12 is a cross-sectional view of an impact dot print head constructed in accordance with still another embodiment of the invention.

FIG. 12 illustrates a print head 660 constructed in accordance with a seventh embodiment of the invention. Spacer 8 is modified in order to prevent solder from flowing to the back of printed circuit board 9 to contact bottom face 10. This prevents a short-circuit when coil terminal pin 12 of the coil terminal portion is soldered to printed circuit board 9 as described in connection with the first embodiment. However, since the thickness of spacer 8 is increased to greater than 0.5 mm, a silicone resin can be injected into the open areas within frame 2.

Figure 13:
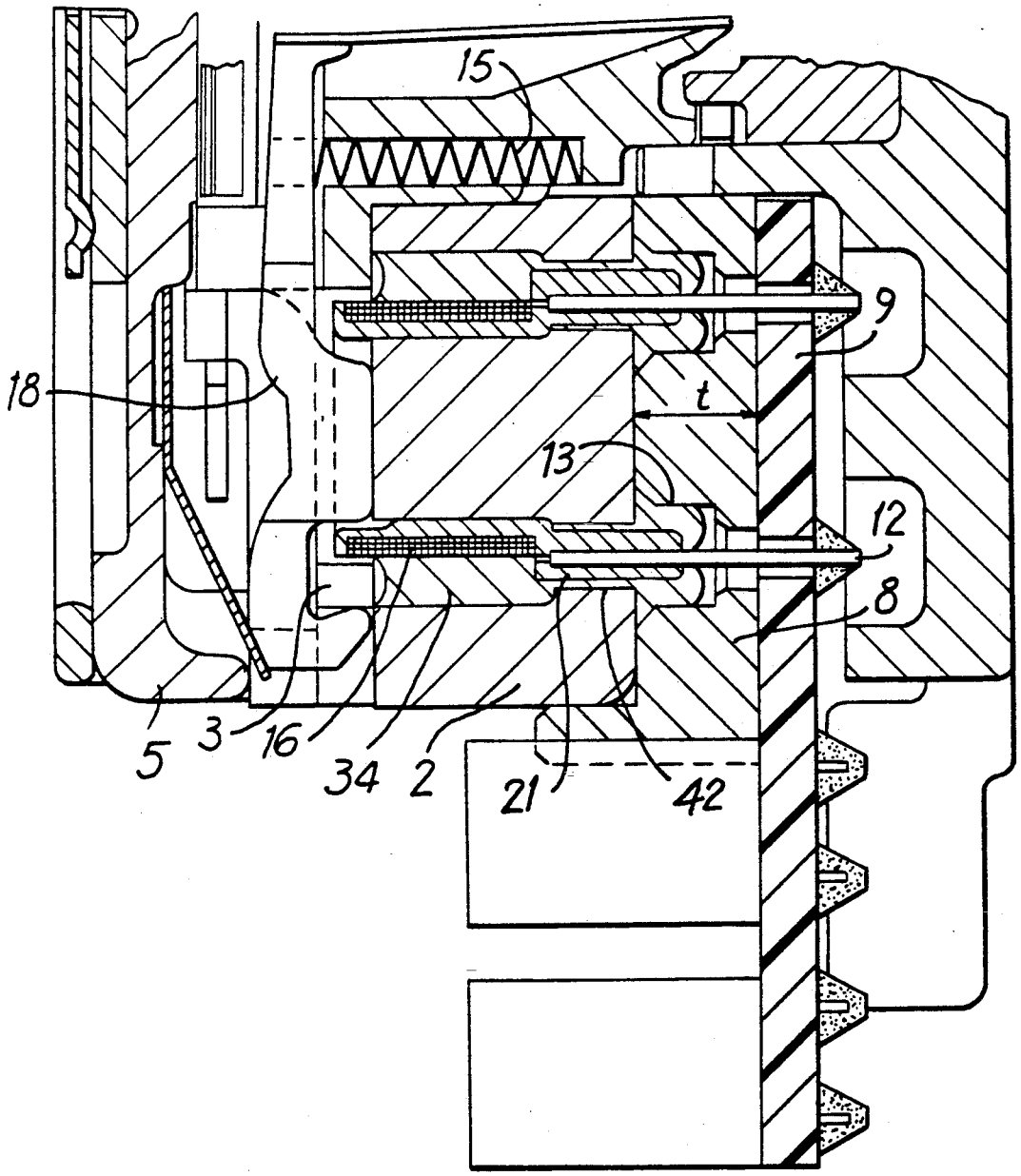
FIG. 13 is an enlarged cross-sectional view of a portion of the print head of FIG. 12.

FIG. 13 is an enlarged view of a portion of print head 660 of FIG. 12 wherein the thickness t of spacer 8 is more than about 0.5 mm. Even if low viscosity silicone 34 (shown as the hatched portion) is injected, it hardens when it flows into the middle of spacer 8. Accordingly, this construction allows use of silicone 34 having a viscosity as low as 250 poise without it leaking on printed circuit board 9. It is preferable to use a low viscosity silicone which is a low molecular weight silicone oil, mixed with a filler, such as aluminum oxide. The silicone is liquid when injected and hardens by a condensed bridging reaction with moisture in the air to form a dialcohol-type silicone rubber.

Figure 1:
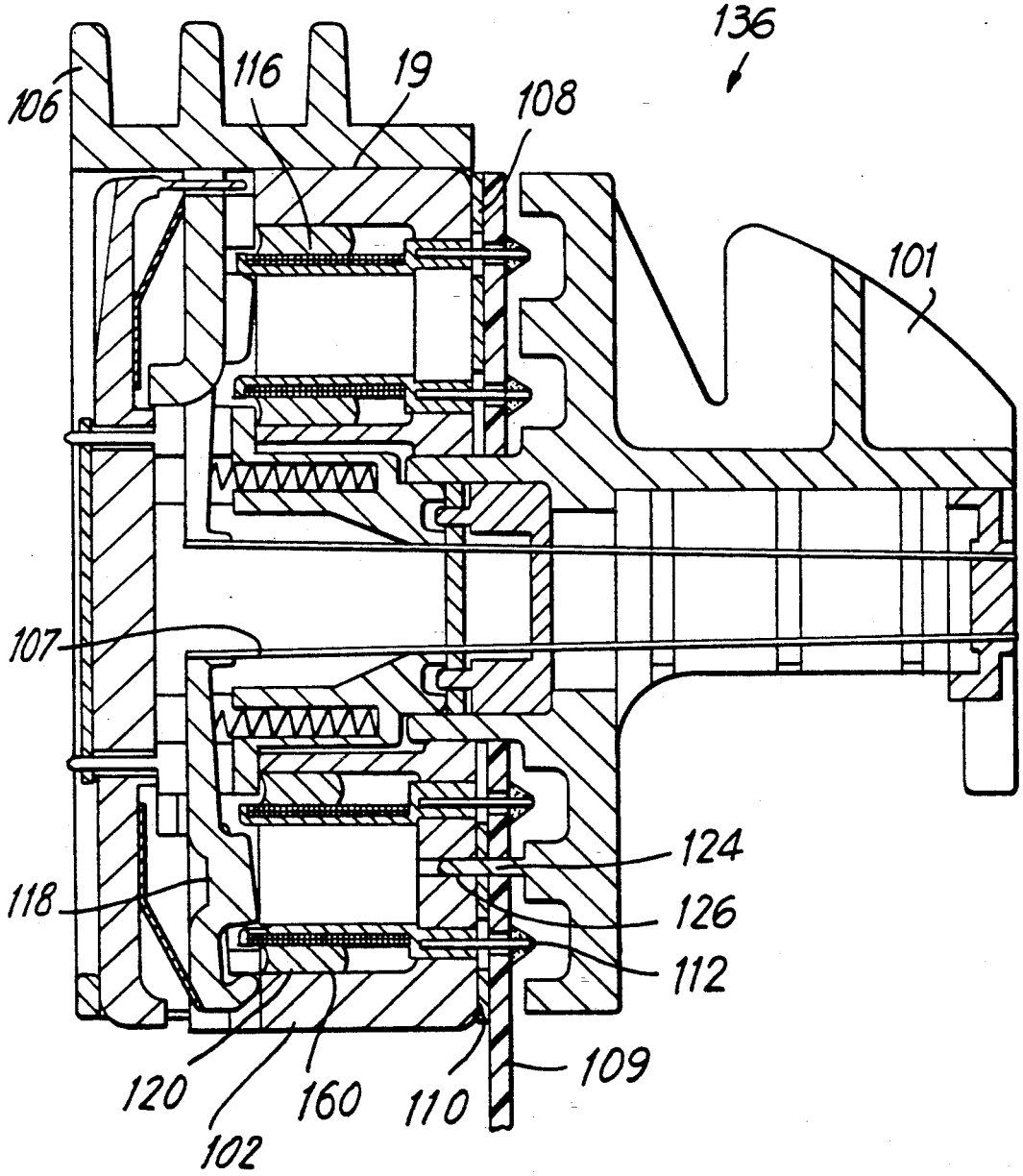
FIG. 1 PRIOR ART
FIG. 1 is a cross-sectional view of an impact dot print head in accordance with the prior art.
Figure 2:
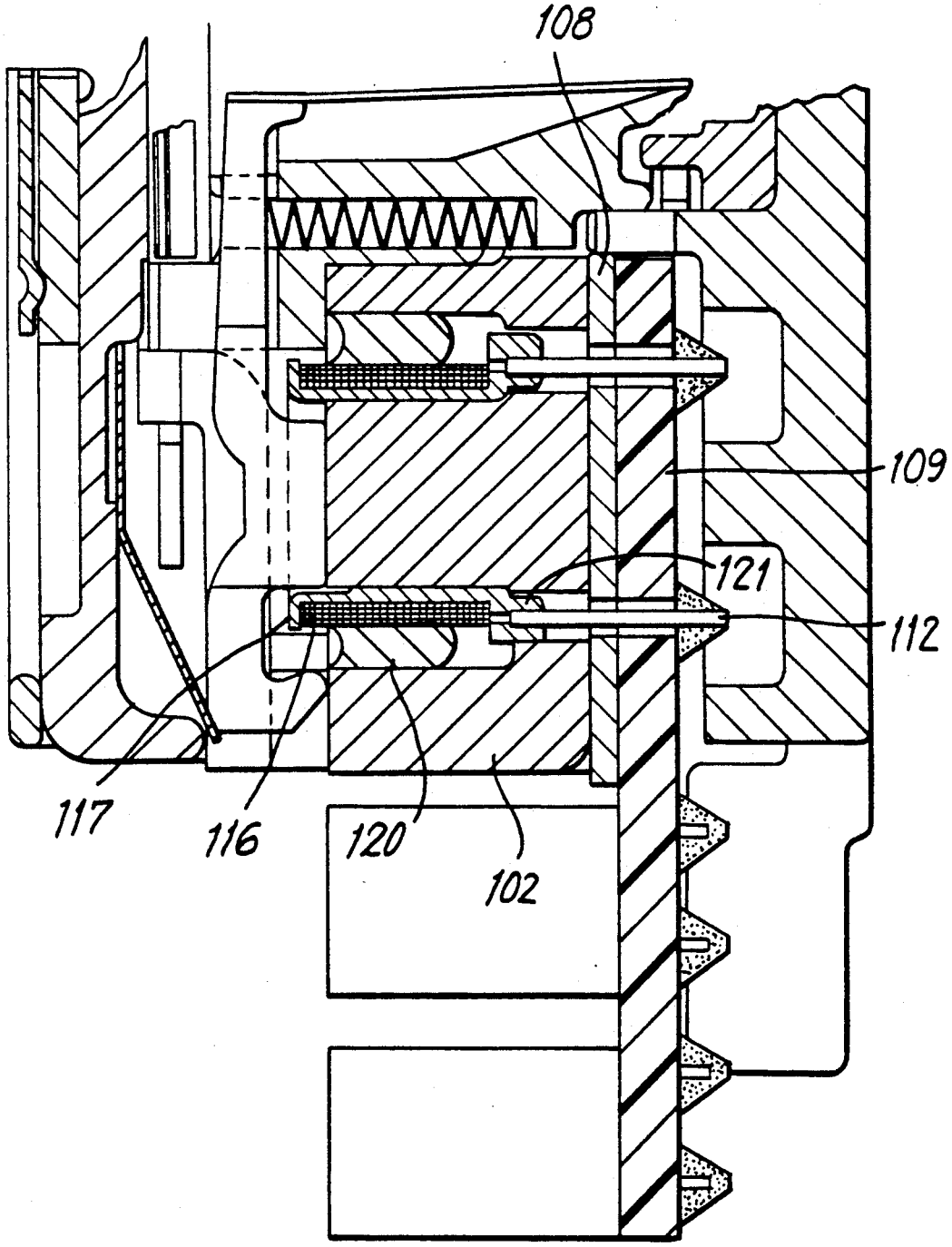
FIG. 2 PRIOR ART
FIG. 2 is an enlarged cross-sectional view of a portion of the print head of FIG. 1.
Figure 3:
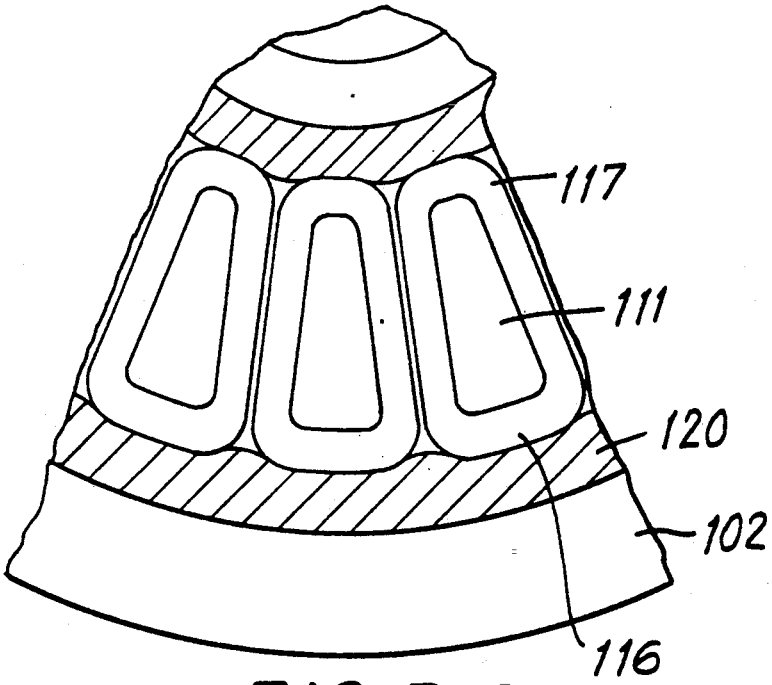
FIG. 3 PRIOR ART
FIG. 3 is a partial cross-sectional view of a portion of the prior art print head of FIGS. 1 and 2.
Figure 14:
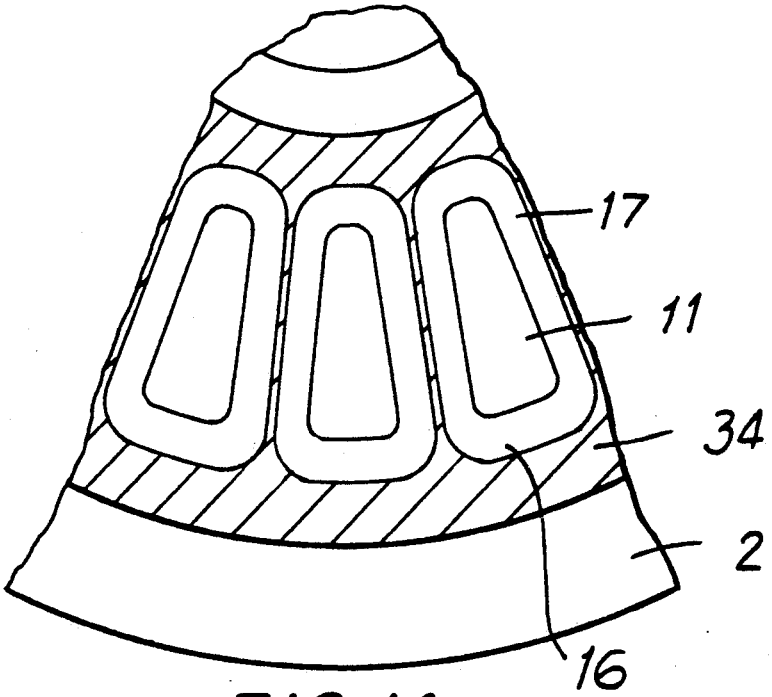
FIG. 14 is a partial cross-sectional view of a portion of the print head of FIGS. 12 and 13.

As shown in FIG. 13, silicone 34 flows through hole 42 in bottom face 10 of frame 2 and into the middle of spacer 8 through hole 13 where silicone 34 hardens. Coil bobbin protrusion member 21 fixes to frame 2 and spacer 8. In the event that there is a winding sag (slack) on solenoid coil 16, silicone 34 prevents a short-circuit caused by friction between coil 16 and frame 2 due to vibration generated when printing wire 7 of impact dot head 36 is driven. Low viscosity silicone 34 also flows in between adjoining solenoid coils 16 as shown in FIG. 14. As a result of this, in the construction of FIGS. 12 and 13, silicone 34 is applied to all the voids around coils 16.

Figure 15:
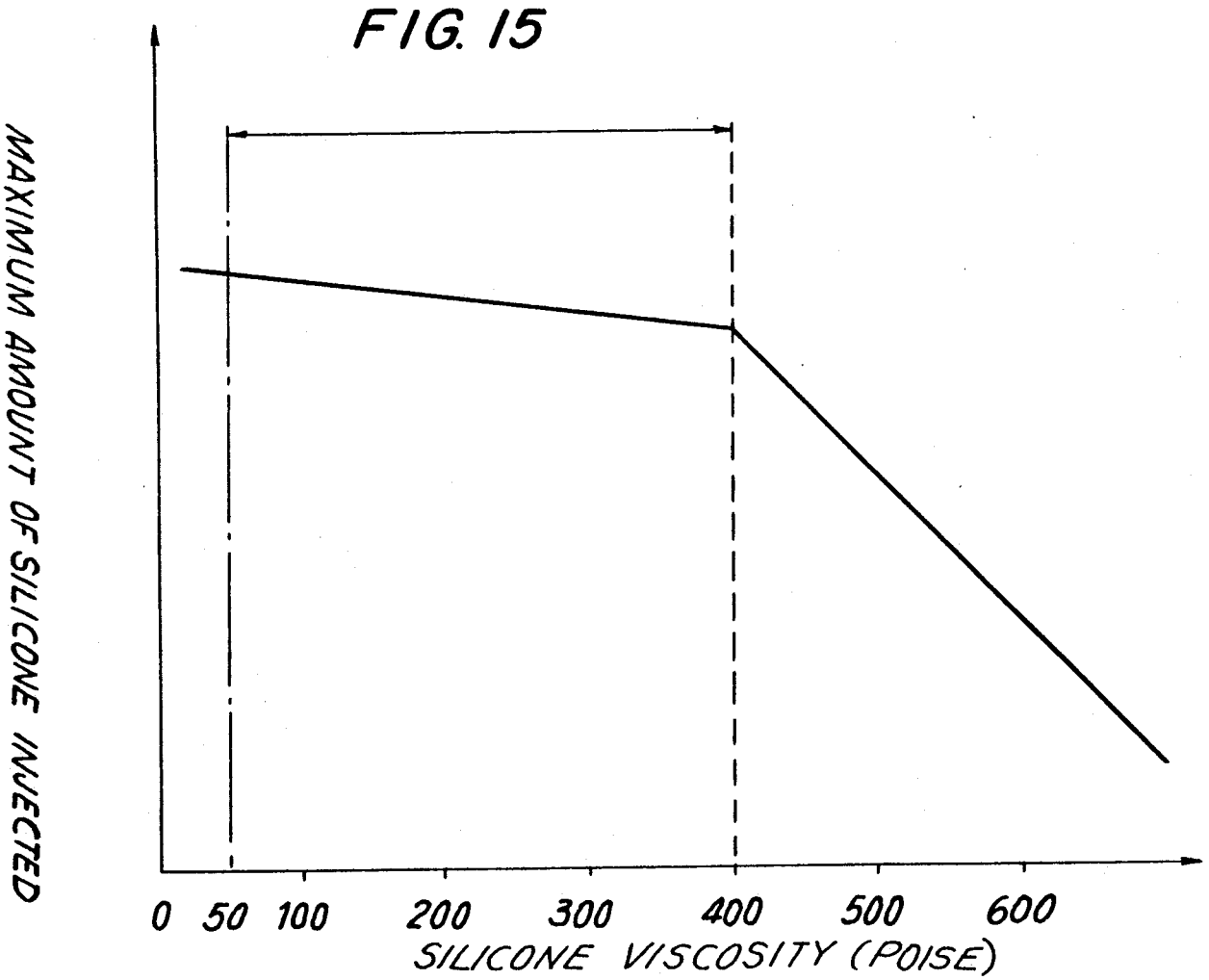
FIG. 15 is a graph illustrating the relationship between the viscosity of silicone and the maximum amount of silicone which can be injected into the print head.

Low viscosity silicone from 50 to 400 poise is preferred in order to have the silicone flow fully into and between all necessary parts without leaking. Silicone 34 also aids in radiating heat away from print head 36. The heat radiating performance of print head 36 is proportional to the amount of injected silicone. However, as shown in FIG. 15, silicone having viscosity of more than 400 poise cannot be fully injected since it is too viscous. The graph in FIG. 15 illustrates that the optimal viscosity range for providing suitable resin flow is between 50 and 400 poise. Silicone with a viscosity of less than 400 poise that insures full injection is preferred. In addition, when the thickness of spacer 8 is less than 0.5 mm, silicone 34 leaks between spacer 8 and printed circuit board 9 through hole 42 on frame 2 if the viscosity is less than 50 poise because the viscosity is too low. In addition, it is also difficult to control the amount of silicone 34 to be injected when the viscosity is below 50 poise, so that the viscosity is preferably between about 50 to 400 poise. This will ensure that silicone 34 is suitable for injecting into print head 36 during the production and for optimizing heat radiating performance of print head 36.

As described above, the construction of a print head in accordance with the invention allows the thickness of spacer 8 to be increased to prevent a short-circuit between printed circuit board 9 and frame 2 and between coils 16 and frame 2 during soldering without adversely affecting the positioning of nose 1, spacer 8 and frame 2. Furthermore, by thickening spacer 8 to more than 0.5 mm and forming it of such materials as a ceramic having excellent heat conductivity and electrical insulating characteristics or an insulating coated metal, the heat generated in frame 2 can be effectively radiated away.

Furthermore, if hole 13 in spacer 8 for inserting coil protrusion portion 21 is enlarged so that solenoid coil 16 and hole 13 do not contact, spacer 8 need not have an electrically insulating quality and therefore any material having excellent heat transfer quality can be used. Moreover, the heat radiating quality of spacer 8 can be improved by extruding spacer 8 to make heat releasing fin 32 and by abutting it to carriage 29.

In addition, in another embodiment, the heat generated in solenoid coil 16 can be effectively transferred and radiated by injecting silicone into bottom face 10 of frame 2, the lower part of solenoid coil 16, coil terminal pin 12 and spacer 8 without any leaking even if low viscosity silicone is used. These improvements remarkably improve the heat transfer and radiating characteristics and thereby remarkably improve the heat radiating performance of print head 36. Furthermore, since silicone 34 can be injected into bottom face 10 of frame 2, the lower part of solenoid coil 16, coil terminal pin 12, and spacer 8, any short-circuit that could occur due to friction and wear of coil 16 and frame 2 by vibration generated when print wire 7 of print head 36 is driven can be prevented even if slack on solenoid coil 16 is present.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A print head for use in a wire impact dot printer comprising:

a frame having a top and bottom, an inner peripheral wall and an outer peripheral wall;

a core block disposed within said frame provided with a plurality of driving coils supported about said core block;

circuit board means for electrically connecting to said driving coils;

spacer means for insulating said frame from said circuit board means, said spacing means between said circuit means and said frame and having a coil aperture dimensioned to receive said driving coils;

a nose storing guiding members for guiding said print wires;

first positioning means on said spacer means for engaging said frame about the outer peripheral wall of said frame;

second projecting positioning means on said spacer means for rotationally positioning said spacer means with respect to said nose; and said spacer formed with a central opening and said nose formed with a projecting central cylindrical projecting member for positioning in said central opening in said nose.

2. The print head of claim 1, wherein said spacer means is substantially planar and is at least about 0.5 mm thick.

3. The print head of claim 2, wherein said spacer means is one of a ceramic material and a metallic member having an insulating coating thereon.

4. The print head of claim 1, wherein said first positioning means includes at least three projecting portions on said spacer means for engaging the outer peripheral wall of said frame.

5. The print head of claim 1, wherein said first positioning means is a cylindrical wall extending from the spacer means for engaging the outer peripheral wall of the frame.

6. The print head of claim wherein the second projecting positioning means includes at least two projections formed on the nose and corresponding holes formed in said spacer means for receiving said projection and preventing rotation of said frame and spacer means.

7. The print head of claim 1, wherein said coils are formed with terminal pins for electrically contacting said circuit means and said spacer is formed with corresponding through holes for allowing the terminal pins to pass therethrough.

8. The print head of claim 7, wherein said spacer means is formed of a metallic member and an insulating coating thereon.

9. The print head of claim 8, wherein said metallic member is aluminum.

10. The print head of claim 1, wherein said spacer means is formed with a heat radiating fin structure for dissipating heat generated within said print head.

11. The print head of claim 10, wherein said heat radiating fin essentially extends around said outer peripheral wall of said frame.

12. The print head of claim 1, further including a heat conductive resin injected into said frame in the space between said coils and between said frame and spacer means.

13. The print head of claim 12, wherein said heat conductive resin is a low viscosity silicone resin.

14. The print head of claim 13, wherein said heat conductive resin includes aluminum oxide.

15. The print head of claim 13, wherein said silicone resin has a viscosity from about 50 to about 400 poise.

16. The print head of claim 13, wherein said heat conductive silicone resin has a viscosity of about 250 poise.

17. The print head of claim 7, wherein said coils and terminal pins do not contact said spacer.

18. An impact dot printer including a print head comprising:

a frame having a top and bottom, an inner peripheral wall and an outer peripheral wall;

a core block disposed within said frame provided with a plurality of driving coils supported about said core block;

circuit board means for electrically connecting to said driving coils;

spacer means for insulating said frame from said circuit board means, said spacing means between said circuit means and said frame and having a coil aperture dimensioned to receive said driving coils;

a nose coupled to said circuit means for storing and guiding said print wires;

first positioning means on said spacer means for engaging said frame about the outer peripheral wall of said frame;

second projecting positioning means on said spacer means for rotationally positioning said spacer means with respect to said nose; and said spacer formed with a central opening and said nose formed with a projecting central cylindrical projecting member for positioning in said central opening in said nose.

19. The printer of claim 18, wherein said spacer means is substantially planar and is at least about 0.5 mm thick.

20. The printer of claim 19, wherein said spacer means is one of a ceramic material and a metallic member having an insulating coating thereon.

21. The printer of claim 18, wherein said first positioning means includes at least three projecting portions on said spacer means for engaging the outer peripheral wall of said frame.

22. The print head of claim 18, wherein said first positioning means is a cylindrical wall extending from the spacer means for engaging the outer peripheral wall of the frame.

23. The print head of claim 18, wherein the second projecting positioning means includes at least two projections formed on the nose and corresponding holes formed in said spacer means for receiving said projection and preventing rotation of said frame and spacer means.

24. The print head of claim 18, wherein said coils are formed with terminal pins for electrically contacting said circuit means and said spacer is formed with corresponding through holes for allowing the terminal pins to pass therethrough.

25. The print head of claim 24, wherein said spacer means is formed of a metallic member and an insulating coating thereon.

26. The print head of claim 25, wherein said metallic member is aluminum.

27. The printer of claim 18, including a carriage mounted for displacement within said printer, said print head mounted on said carriage and said spacer means formed with a heat radiating fin structure for dissipating heat generated within said print head, said fin structure contacting said carriage for transferring heat to said carriage.

28. The print head of claim 18, wherein said spacer means is formed with a heat radiating fin structure for dissipating heat generated within said print head.

29. The print head of claim 28, wherein said heat radiating fin essentially extends around said outer peripheral wall of said frame.

30. The print head of claim 18, further including a heat conductive resin injected into said frame in the space between said coils and between said frame and spacer means.

31. The print head of claim 30, wherein said heat conductive resin is a low viscosity silicone resin.

32. The print head of claim 31, wherein said silicone resin has a viscosity from about 50 to about 400 poise.

33. The print head of claim 24, wherein said coils and terminal pins do not contact said spacer.

* * * * *